US007618002B2

(12) United States Patent
Sato

(10) Patent No.: US 7,618,002 B2
(45) Date of Patent: Nov. 17, 2009

(54) EMPTY CAN PROCESSING VEHICLE

(76) Inventor: Youichi Sato, 22-2 Aza Yamane, Maeyachi, Ishinomaki-shi, Miyagi-ken (JP)

( * ) Notice: Subject to any disclaimer, the term of this patent is extended or adjusted under 35 U.S.C. 154(b) by 503 days.

(21) Appl. No.: 11/505,908

(22) Filed: Aug. 18, 2006

(65) Prior Publication Data

US 2007/0040057 A1 Feb. 22, 2007

(30) Foreign Application Priority Data

Aug. 18, 2005 (JP) ..... 2005-237288

(51) Int. Cl.
*B02C 23/08* (2006.01)

(52) U.S. Cl. ..... 241/79.1; 241/79.3; 241/101.741

(58) Field of Classification Search ..... 241/57, 241/24.11, 24.14, 101.741, 79.1, 79.3, DIG. 38
See application file for complete search history.

(56) References Cited

U.S. PATENT DOCUMENTS 4,979,866 A * 12/1990 Croy ..... 414/517
5,151,005 A * 9/1992 Spigner ..... 414/437
5,405,093 A * 4/1995 Bozarth ..... 241/34
5,511,687 A * 4/1996 Garrett et al. ..... 414/407
5,842,652 A * 12/1998 Warsing et al. ..... 241/81
5,938,132 A * 8/1999 Shinjo et al. ..... 241/79.1
6,447,235 B1 * 9/2002 Galeazzi et al. ..... 414/398
6,499,931 B1 * 12/2002 Garrett et al. ..... 414/406
7,434,507 B1 * 10/2008 Sherwood et al. ..... 100/233
2003/0003568 A1 * 1/2003 Yilmaz ..... 435/262
2004/0141877 A1 * 7/2004 Devine et al. ..... 422/32
2004/0206675 A1 * 10/2004 Okamoto et al. ..... 209/421

* cited by examiner

*Primary Examiner*—Bena Miller
(74) *Attorney, Agent, or Firm*—Wenderoth, Lind & Ponack, L.L.P.

(57) ABSTRACT

An empty can processing vehicle includes first, second, and third chambers formed by partitioning a platform of a van track with partition walls, a can crushing machine disposed in the first chamber to crush an empty can supplied from a can inlet port to a casing and to discharge can chips from a can chip outlet port, and a can chip magnetic separation machine disposed in the second chamber to separate the can chips sent from the can crushing machine via a can chip outlet tube into steel chips and aluminum chips through magnetic force; the steel chips are stored in the second chamber; and the aluminum chips are stored in the third chamber.

7 Claims, 11 Drawing Sheets

$V_S = 1.2 \times 2.2 \times 1.2 \fallingdotseq 3.2 m^3$ $V_A = 2.45 \times 2.2 \times 1.8 \fallingdotseq 9.5 m^3$

EMPTY CAN PROCESSING VEHICLE

BACKGROUND OF THE INVENTION

1. Field of the Invention

The present invention relates generally to a vehicle that processes empty cans, and, more particularly, to an empty can processing vehicle that processes and recycles empty cans.

2. Description of the Related Art

In a conventional empty can treatment/recycle system, empty cans accumulated at a garbage collection site are loaded on a collection vehicle and carried to a treatment plant; while conveying the cans with a large conveyer in the treatment plant, a large number of workers deployed along the conveyer manually select aluminum cans, steel cans, etc.; the cans are pressed by a pressing machine; and an acquired rectangular pressed object is stored in a storage place. Recycle makers crush the accepted pressed object and separates steel chips and aluminum chips.

However, such a conventional empty can processing method has the following problems.

(1) A carrying efficiency is reduced by collecting and carrying uncollapsed empty cans with the collection vehicle since the cans take up much space.

(2) As the empty cans increase, a facility grows in size, and costs of equipment, vehicle, and manpower are increased.

(3) If a spray can is mixed in empty cans, a remaining gas may leak within the collection vehicle, resulting in a fire accident.

(4) Workers may be injured by a piece of broken glass mixed on the conveyer during the manual selecting operation.

(5) Since undrunk liquid often remains in a collected can or rain water often adheres to a surface of an empty can, if the can is pressed in such a state, the liquid is contained in the pressed object and adversely affects the quality of can chips, especially aluminum chips, and therefore, recycle makers must spend considerable cost and effort to sterilize and dry the cans.

SUMMARY OF THE INVENTION

The present invention was conceived in consideration of the above situations and it is therefore the object of the present invention to provide an empty can processing vehicle that can collect, crush, and select empty cans on the vehicle, and that ensures high efficiency, low costs, excellent safety, and acquisition of high-quality separated chips.

In order to achieve the above object, according to a major aspect of the present invention there is provided an empty can processing vehicle comprising first, second, and third chambers formed by partitioning a platform of a van track; a can crushing machine disposed in the first chamber to crush an empty can introduced from a can inlet port to a can crushing chamber and to discharge can chips from a can chip outlet port; and a can chip magnetic separation machine disposed in the second chamber to separate the can chips discharged from the can chip outlet port into steel chips and aluminum chips through magnetic force, the vehicle storing the steel chips separated by the can chip magnetic separation machine in the second chamber, the vehicle storing the aluminum chips separated by the can chip magnetic separation machine in the third chamber.

In the above configuration, the empty can is supplied to the can crushing machine in the first chamber and is crushed; the acquired can chips are sent to the magnetic separation machine in the second chamber and are separated into the steel chips and the aluminum chips; the steel chips are received in the second chamber; and the aluminum chips are received in the third chamber. Therefore, a series of empty can treatment processes of collecting and crushing empty cans and separating chips can be performed on one vehicle.

In one preferred aspect, the first, second, and third chambers are disposed on a rear portion, an intermediate portion, and a front portion, respectively, of the platform of the van truck. Alternatively, the first, second, and third chambers are preferably disposed on a front portion, an intermediate portion, and a rear portion, respectively, of the platform of the van truck as well.

According to one preferred aspect, each of the first, second, and third chambers is disposed with an individual opening/closing door. In this case, to avoid interference between the adjacent opening/closing doors, preferably, the opening/closing doors of the first and third chambers are disposed on one side of the platform of the van truck and the opening/closing door of the second chamber is disposed on the other side.

In one preferred aspect, the can inlet port of the can crushing machine is connected with a suction hose for sucking empty cans from the outside of the van truck. This suction hose can be housed in the first chamber and is pulled to the outside of the van truck to suck and send the empty can to the can crushing machine.

In one preferred aspect, the can crushing machine includes: a cylindrical casing that includes the can crushing chamber, the can inlet port, and the can chip outlet port; an impeller that sucks air from the can inlet port and sends air toward the can chip outlet port to guide the empty can supplied from a can supply port to the circumferential direction of the casing; a plurality of can crushing blades that is located at positions surrounding the outer circumference of the impeller to crush the empty can guided by the rotation of the impeller; and a can chip guide path that guides the can chips generated by crushing the empty can to the can chip outlet port through the rotation of the impeller.

In the can crushing machine, in one preferred aspect, a drain hole is formed in the casing to drain liquids or fluids from the can chip guide path. Preferably, the drain hole is formed in the lower portion of the casing and a tank is disposed on the outside of the casing to temporarily store the liquids or fluids drained from the drain hole.

In such a configuration, when the can crushing machine is operated, the empty can supplied from the can inlet port to the can crushing chamber is crushed by the can crushing blades. The can chips and the liquids generated by the crushing are guided along an inner circumference side wall of the can crushing chamber of the can chip guide path to the can chip outlet port by an air flow generated by the rotation of the impeller from the can inlet port along the can chip guide path toward the can chip outlet port. The liquids remaining in or adhering to the empty can are separated and drained by the drain hole disposed in the course of the guiding, and the can chips are directly discharged from the can chip outlet port.

According to one preferred aspect, the can chip magnetic separation machine includes: a body disposed on the upper portion of the second chamber, including a can chip inlet port for introducing the can chips from the can crushing machine, a steel chip outlet port that is terminated in the second chamber, and an aluminum chip outlet port leading to the third chamber; a rotation drum attached rotatably within the body; and a magnet disposed to face to a substantially upper half portion of the inner circumference of the rotation drum, wherein among the can chips introduced from the can chip inlet port into the body, the steel chips are moved downward while attracted to the outer circumference of the rotation drum facing to the magnet, are separated from the rotation drum at a position away from the magnet, and are discharged from the steel chip outlet port and, after removing the steel chips, the remaining aluminum chips are discharged from the aluminum chip outlet port. In such a configuration, the can chips sent from the can crushing machine are separated into the steel chips and aluminum chips; the steel chips can be received in the second chamber; and the aluminum chips can be received in the third chamber.

According to one preferred aspect, a can chip outlet tube is included which passes through a partition wall partitioning the first chamber and the second chamber to extend into the both chambers, and the can chip outlet tube is connected at a stat end to the can chip outlet port of the crushing machine and is connected at a terminal end to the can chip inlet port of the can chip magnetic separation machine. Since the can chips are transferred from the crushing machine in the first chamber to the can chip magnetic separation machine in the second chamber through the inside of the can chip outlet tube, the can chips are prevented from scattering and dispersing and can be put into the next chip separation process quickly.

According to one preferred aspect, an aluminum chip outlet tube is included which passes through a partition wall partitioning the second chamber and the third chamber to extend into the both chambers, and the aluminum chip outlet tube is connected at a stat end to the aluminum chip outlet port of the body of the can chip magnetic separation machine and is opened at a terminal end in the third chamber. Since the aluminum chips selected by the can chip magnetic separation machine are sent to the third chamber through the inside of the can chip outlet tube, the aluminum chips can be certainly prevented from entering into the second chamber to be mixed with the steel chips.

According to one preferred aspect, an opening is formed on the partition wall partitioning the second chamber and the third chamber to allow air to flow between the both chambers and an exhausting unit is disposed in at least one of the second and third chambers to exhaust air in the chamber to the outside. In one preferred aspect, the exhausting unit includes a cylindrical-body that traverses the second and/or third chamber in a longitudinal or transverse direction to be opened at either or both ends outside the chamber, and a large number of through-holes disposed on the side of the cylindrical body. In such a configuration, since air and other gasses are emitted along with the steel chips and the aluminum chips from the can chip magnetic separation machine and are exhausted via the exhausting unit to the outside of the platform, the pressure in the platform can be effectively prevented from increasing (and thereby reducing the chip discharging efficiency from the can chip magnetic separation machine).

In one preferred aspect, a portable steel chip container can be disposed in the second chamber to receive, collect, and store the steel chips selected by the can chip magnetic separation machine and a portable aluminum chip container can be disposed in the third chamber to receive, collect, and store the aluminum chips selected by the can chip magnetic separation machine.

A second empty can processing vehicle of the present invention includes: first, second, and third spaces disposed in a platform of a van track; a can crushing machine disposed in the first space to crush an empty can introduced from a can inlet port to a can crushing chamber and to discharge can chips from a can chip outlet port; a can chip magnetic separation machine disposed in the second space to separate the can chips discharged from the can chip outlet port into steel chips and aluminum chips through magnetic force; a steel chip container disposed in the second space to store the steel chips separated by the can chip magnetic separation machine; and an aluminum chip container disposed in the third space to store the aluminum chips separated by the can chip magnetic separation machine.

In the above configuration, the empty can is supplied to the can crushing machine in the first space and is crushed; the acquired can chips are sent to the magnetic separation machine in the second space and are separated into the steel chips and the aluminum chips; the steel chips are received by the steel chip container in the second space; and the aluminum chips are received by the aluminum chip container in the third space. A series of empty can treatment processes of collecting and crushing empty cans and separating chips can be performed on one vehicle as is the case with the first empty can processing vehicle.

In one preferred aspect, the first, second, and third spaces are disposed on a rear portion, an intermediate portion, and a front portion, respectively, of the platform of the van truck. Alternatively, the first, second, and third spaces are preferably disposed on a front portion, an intermediate portion, and a rear portion, respectively, of the platform of the van truck as well.

According to an empty can processing vehicle of the present invention, because of the configuration and action described above, empty cans can be collected and crushed and chips can be separated on one vehicle, and empty can treatment can be performed efficiently at low cost. Since a person does not have to touch the empty can or can chips with hands in the operation, the present invention is highly hygienic and safe, and since the remaining liquid in the empty can is not mixed with the chips, high-quality chip product can be acquired.

BRIEF DESCRIPTION OF THE DRAWINGS

The above and other objects, aspects, features and advantages of the present invention will become more apparent from the following detailed description when taken in conjunction with the accompanying drawings, in which.

DETAILED DESCRIPTION OF THE PREFERRED EMBODIMENTS

Description will hereinafter be made of preferred embodiments of the present invention with reference to the accompanying drawings.

Figure 1:
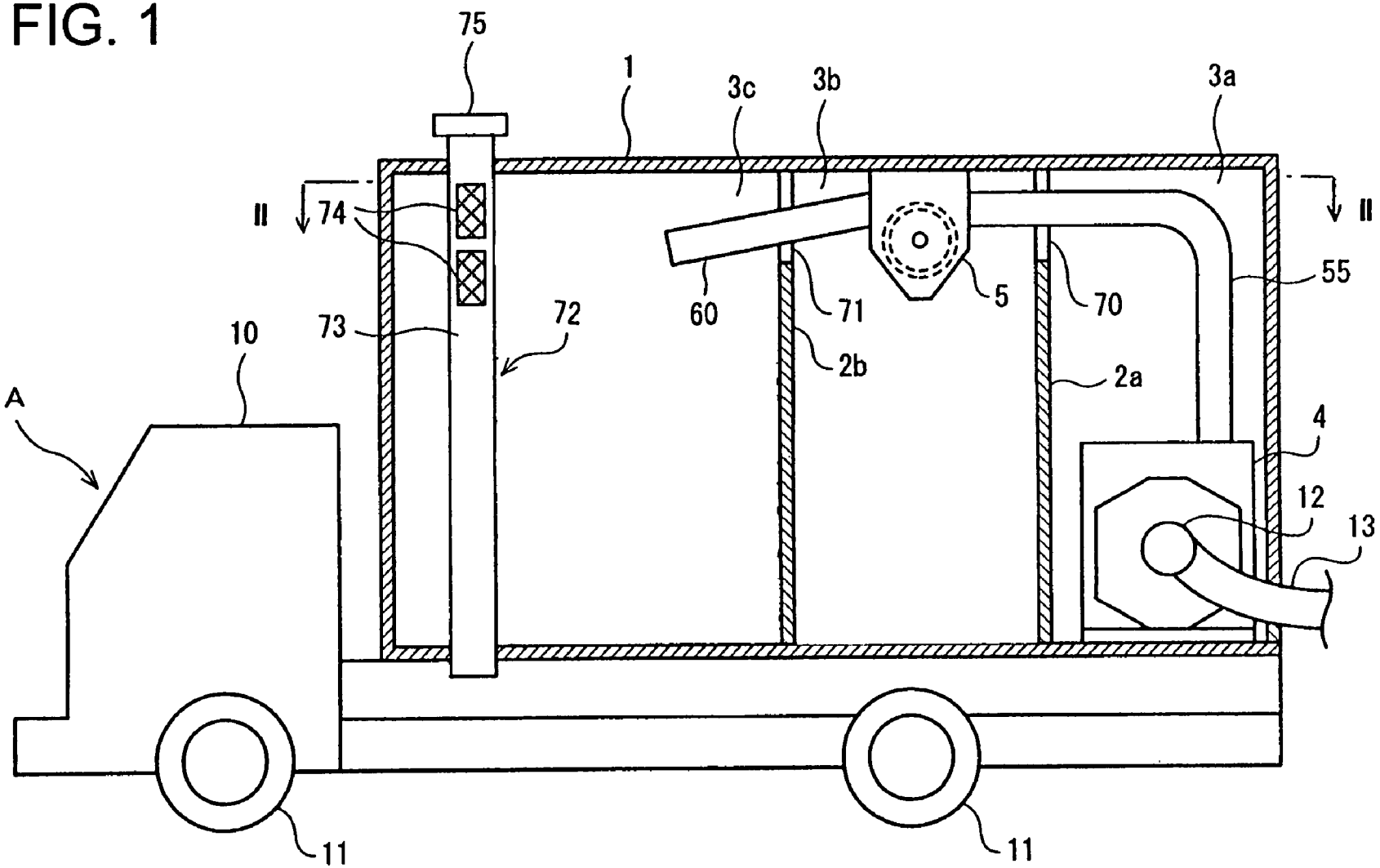
FIG. 1 is a cross sectional side view of a configuration of relevant components of an empty can processing vehicle in one embodiment of the present invention.
Figure 2:
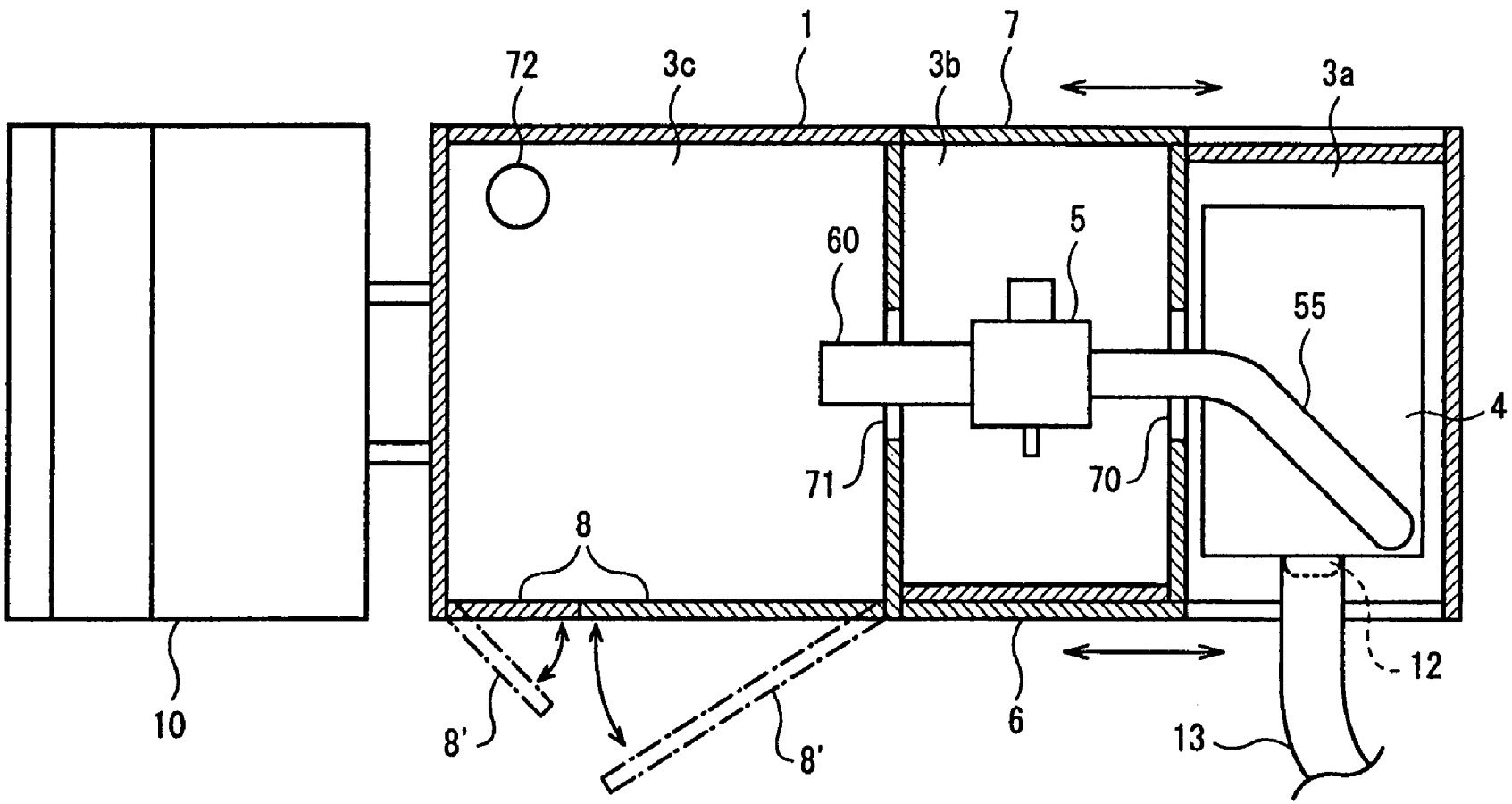
FIG. 2 is a cross sectional view along a II-II line of FIG. 1.

FIGS. 1 and 2 show a configuration of an empty can processing vehicle in one embodiment of the present invention.

FIG. 1 is a cross sectional side view and FIG. 2 is a cross sectional view along a II-II line shown in FIG. 1.

An empty can processing vehicle in this embodiment includes: an aluminum van or platform 1 in a shape of a rectangular parallelepiped; a first chamber 3*a*, a second chamber 3*b*, and a third chamber 3*c* formed by partitioning the platform 1 with two partition walls 2*a*, 2*b* located in a longitudinal direction of the vehicle at desired intervals; a can crushing machine 4 disposed in the first chamber 3*a*; and a can chip magnetic separation machine 5 disposed in the second chamber 3*b*. The first chamber 3*a*, the second chamber 3*b*, and the third chamber 3*c* are located in a rear portion, an intermediate portion, and a front portion, respectively, of the platform 1. In FIG. 1, a reference numeral 10 indicates a driver seat and a reference numeral 11 indicates wheels.

As shown in FIG. 2, doors 6, 7, 8 are disposed on the sides of the platform 1 to individually open and close the first to third chambers 3*a*, 3*b*, 3*c*. More particularly, to the forward direction of the track, the doors 6, 8 of the first chamber 3*a* and the third chamber 3*c* are disposed on the left side of the platform 1, and the door 7 of the second chamber 3*b* is disposed on the right side of the platform 1. The doors 6, 7 of the first chamber 3*a* and the second chamber 3*b* are the sliding type and the door 8 of the third chamber 3*c* is the double hinged type. Due to such an arrangement, the doors 6, 7, 8 can be opened and closed independently without interfering with each other.

Figure 3:
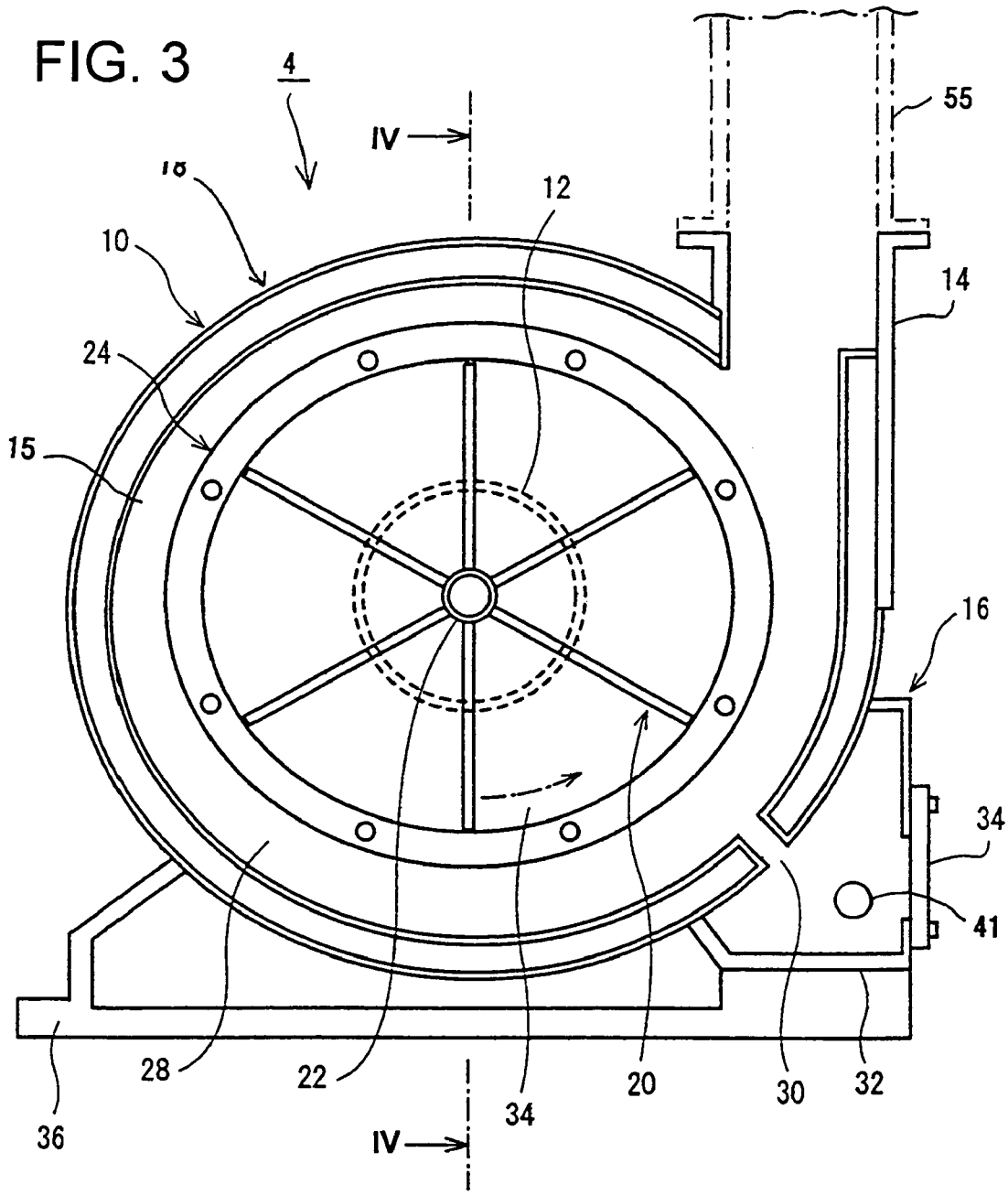
FIG. 3 is a cross sectional front view of a configuration of a can crushing machine.
Figure 4:
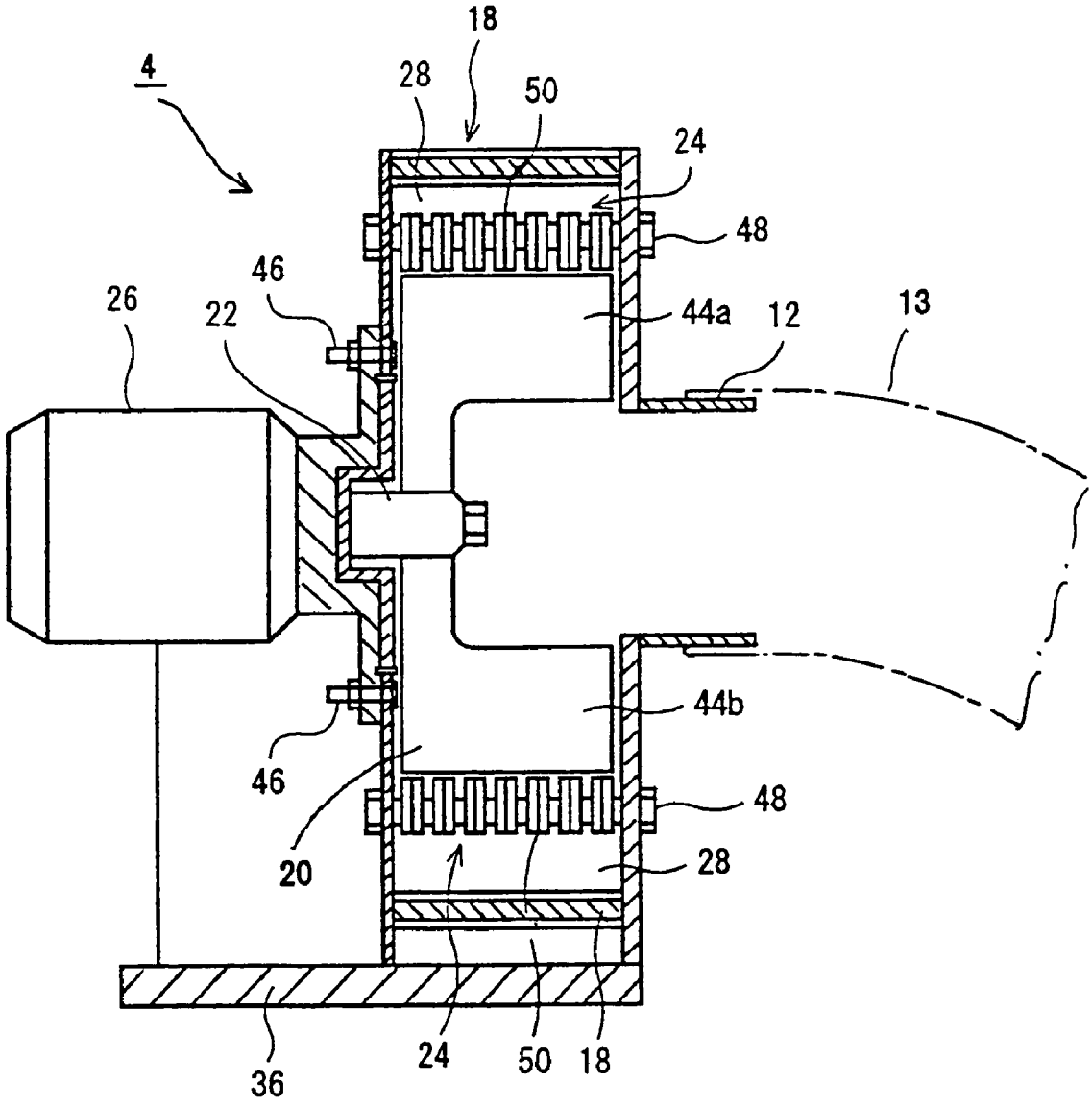
FIG. 4 is a IV-IV line cross sectional view of the can crushing machine.
Figure 5:
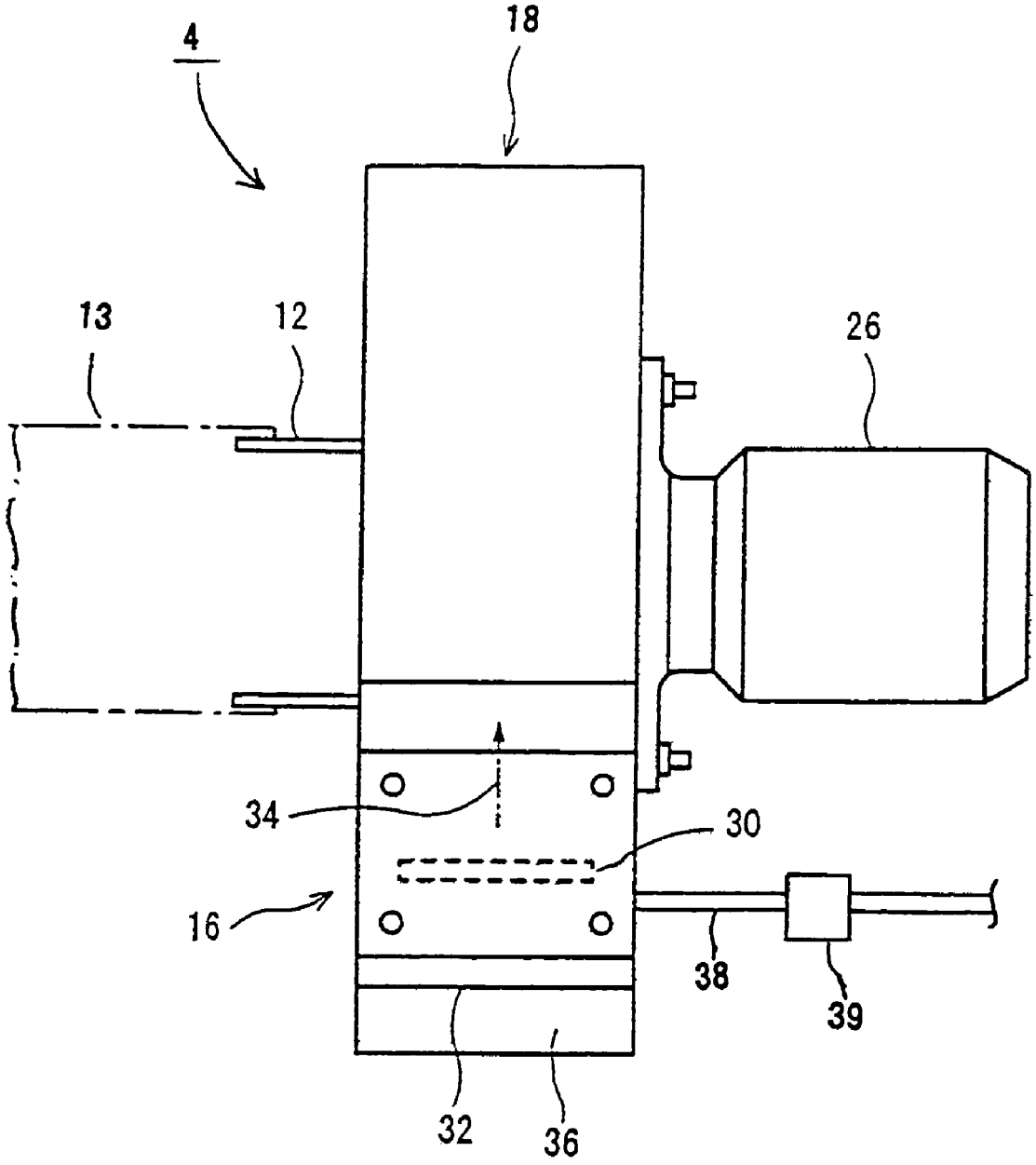
FIG. 5 is a right side view of FIG. 3.
Figure 6:
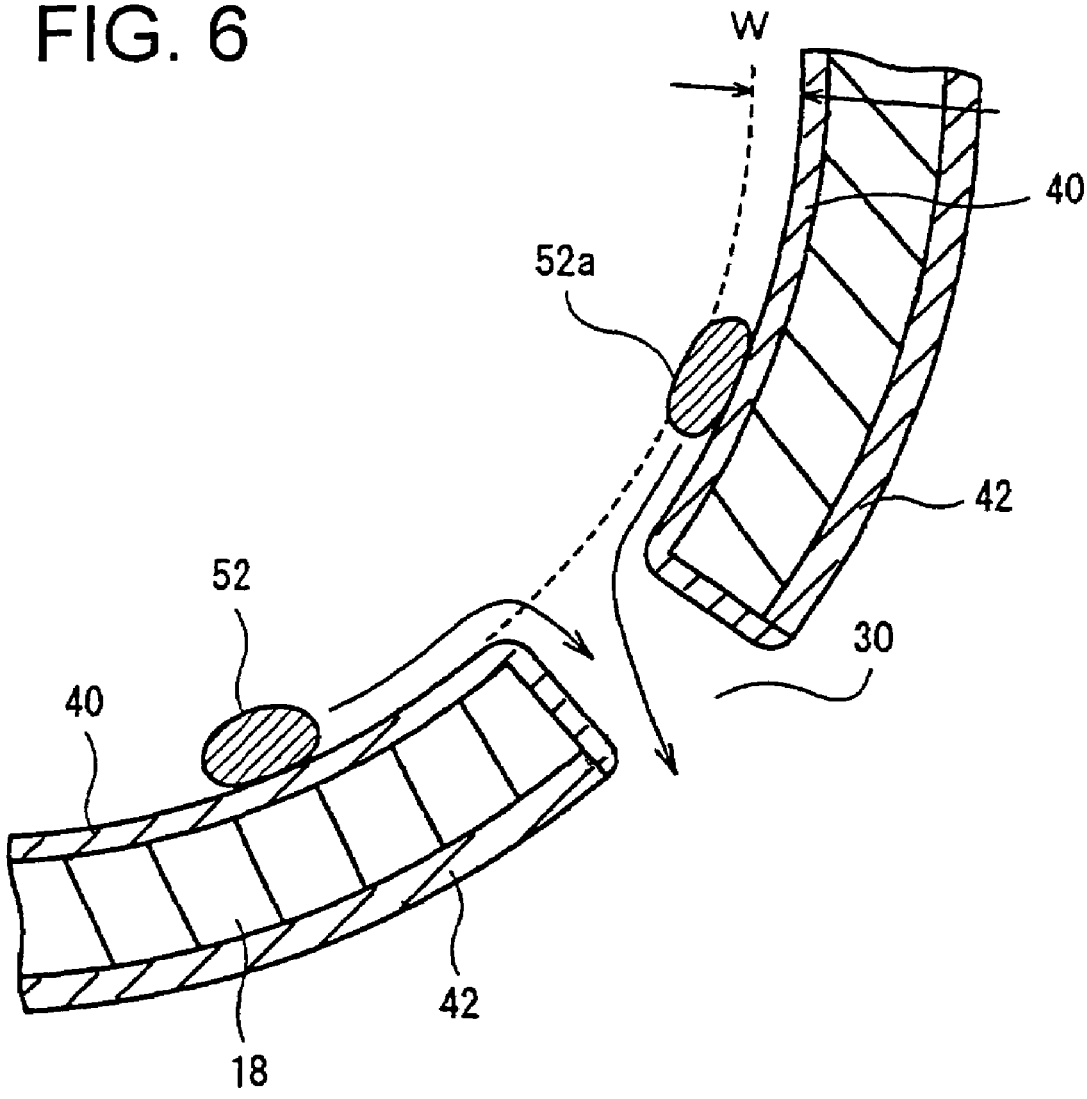
FIG. 6 is an enlarged cross sectional view of a can liquid removing portion of the can crushing machine.

FIGS. 3 to 6 show a configuration of the can crushing machine 4 in one example. FIG. 3 is a cross sectional front view of the can crushing machine 4; FIG. 4 is a cross sectional view along IV-IV of FIG. 3; FIG. 5 is a side view when viewed from the side of a can liquid removing portion; and FIG. 6 is an enlarged cross sectional view of a drain hole portion.

As shown in FIGS. 3 and 4, the can crushing machine 4 includes a casing 18 including a circular can crushing chamber 15, an impeller 20 coupled to a rotation shaft 22 and rotated within the can crushing chamber 15, can crushing blades 24 fixed to the casing 18 to surround the impeller 20, and a rotary driving unit 26 consisting of an internal-combustion engine or electric motor attached to the back side of the casing to rotationally drive the impeller 20.

The casing 18 is made of, for example, cast metal, ceramic, and steel material and has a cylindrical shape; an annular can chip guide path 28 is disposed between the inner circumferential wall of the casing 18 and the can crushing blades 24; a can inlet port 12 is disposed in the center portion of the front side of the casing 18; and an upward-facing can chip outlet port 14 is disposed and in communication with the can chip guide path 28. The can inlet port 12 has an opening of a size that enables empty cans to be introduced in series and is coupled to a suction hose 13 that can be pulled to the outside of the platform 1. The suction hose 13 can be housed in the first chamber 3*a* and can be pulled to the outside of the vehicle when the door 6 on the left side (walkway side) of the platform 1 is opened. The can chip outlet port 14 is connected with a can chip outlet tube 55 described later.

As shown in FIG. 3, the impeller 20 includes an arbitrary plurality of slats 44*a*, 44*b* . . . (in this embodiment, six slats) attached detachably to the rotation shaft 22 rotationally driven by the rotary driving unit 26, and the slats extend radially from the rotation shaft 22 to the inner wall of the casing 18. The motor 26 is fixed to the casing 18 via bolts 46 as shown in FIG. 4. The can crushing blades 24 are attached to the casing 18 with bolts 48 so as to surround the tips of the slats 44*a*, 44*b* . . . with a slight clearance.

As shown in FIG. 4, the can crushing blades 24 are a plurality of steel sheet crushing blades 50 fixedly attached in close proximity to the tips of the slats 44*a*, 44*b* . . . in a circular arc shape. A thickness of the steel sheet crushing blades 50 is about 5 mm and a distance between the adjacent steel sheet crushing blades 50 is about 10 mm. The distance between the steel sheet crushing blades 50 is selected depending on dimensions of can chips acquired by crushing empty cans.

A drain hole 30 is formed in the casing 18 to drain liquids or fluids remaining in or adhering to empty cans. A tank is disposed on the outside of the casing 18 to store the liquids drained from the drain hole 30. The drain hole 30 and the tank 32 constitute a can liquid removing unit 16. The tank 32 is disposed with an inspection lid 34 that opens and closes an inspection opening. As shown in FIG. 3, the drain hole 30 is preferably disposed in an area closer to the can chip outlet port 14 than the rotation shaft 22 of the impeller 20 along the rotation direction of the impeller 20 in the can chip guide path 28, especially, at the position under the can chip outlet port 14. The can liquid removing unit 16 is mounted on a pedestal 36 of the can crushing machine along with the casing 18, the can inlet port 12, and the can chip outlet port 14.

As shown in FIG. 5, the drain hole 30 has a shape of a slit perforated in a direction orthogonal to the rotation direction of the impeller 20, may have substantially the same width as that of the can chip guide path 28, and may have a width narrower that the can chip guide path 28. In any case, the drain hole 30 have dimensions smaller than the can chip; the drain hole 30 is not limited to a slit and may be a plurality of holes; and the drain hole 30 is not limited to one position and may be disposed at a plurality of positions. The tank 32 is connected with a drain tube 38 and a manual opening/closing valve 39 is disposed in the middle of the drain tube 38.

FIG. 6 shows an enlarged configuration near the drain hole 30. As shown in FIG. 6, a water-shedding lining material 40 is applied to the inner circumferential side wall surface of the casing 18 and the end face of the drain hole 30.

Description will be made of the operation of the can crushing machine 4 configured as above.

The rotary driving unit 26 rotationally drives the impeller 20 to suck empty cans M (FIG. 8) along with air from the hose 13 coupled to the can inlet port 12 into the casing 18. The sucked empty cans are guided from the center portion of the slats 44*a*, 44*b* . . . to the circumferential direction through the rotation of the impeller 20, and the guided empty cans are pressed against the can crushing blades 24 attached to the casing 18 by the centrifugal force generated by the rotation of the slats 44*a*, 44*b* . . . . Concurrently, the empty cans pressed against the can crushing blades 24 by the rotation of the slats 44*a*, 44*b* are crushed by the rotational force of the slats 44*a*, 44*b* and the can crushing blades 24 to become chips, which are sent to the can chip guide path 28 from between the steel sheet crushing blades 50 constituting the can crushing blades 24. An air flow is generated by the rotation of the slats 44*a*, 44*b* . . . from the can inlet port 12 through the can chip guide path 28 toward the can chip outlet port 14 and guides the can chips sent out to the can chip guide path 28 along the inner circumferential side wall of the casing 18 to the can chip outlet port 14, and the can chips are discharged from the can chip outlet port 14 to the outside vertically upward. When an empty can is crushed and changed to chips, the volume is reduced to 1/10.

In the formation of the chips from the empty cans as described above, the can crushing blades 24 crush the empty cans and scatter liquids such as moisture adhering to the empty cans or remaining liquids in the empty cans. The scattered liquid is collected on the inner circumferential side wall of the casing 18 of the can chip guide path 28 by the pressure of the air flow generated by the rotation of the slats 44*a*,

44*b* . . . . The liquid collected on the inner circumferential side wall forms a droplet 52 as shown in FIG. 6 and is swept away along the inner circumferential side wall surface of the casing 18 to the can chip outlet port 14 by the air flow pressure generated toward the can chip outlet port 14. The droplet is then drained from the drain hole 30 to the tank 32 of the can liquid removing unit 16.

As shown in FIG. 6, a difference W is provided between the surface of the lining material 40 of the casing 18*a* of the upper portion of the drain hole 30 located near the can chip outlet port 14 and the surface of the lining material 40 of the casing 18 located at the lower portion of the drain hole 30. That is, with regard to the guidance of the can chips through the can chip guide path, the difference W is formed between the inner circumference side wall of the casing 18 located upstream of the drain hole 30 and the inner circumference side wall of the casing 18 located downstream of the drain hole 30, and the downstream inner circumference side wall of the casing 18 is expanded more than the upstream inner circumference side wall of the casing 18 in the centrifugal force direction of the rotation of the impeller 20.

Because of this configuration, the can chips are smoothly transferred to the can chip outlet port 14 by the air flow pressure due to the rotation of the slats 44*a*, 44*b* . . . along the inner circumference side wall of the casing 18 of the can chip guide path 28 without getting stuck with the drain hole 30. When the rotation of the impeller 20 is stopped, the air flow is stopped, and a droplet 52*a* flows down due to gravity from the inner circumferential side wall of the can chip guide path 28 between the can chip outlet port 14 and the drain hole 30 to the area under the can chip outlet port 14 along the inner circumferential side wall and is drained through the drain hole 30. If water-shedding lining material 40 exists on the surface of the casing 18 as shown in FIG. 6, the resistance to the flow of the droplet 52 is reduced and liquids can be drained through the drain hole 30 extremely easily.

For example, fluids such as powdery crushed wastes generated by forming chips of empty cans are also drained from the drain hole 30 to the tank in addition to the liquids separated from the can chips. The waste liquids including the crushed wastes are accumulated in the tank 32. After going round for collecting empty cans, the opening/closing valve 39 is opened at the empty can collection center and the waste liquids in the tank 32 are drained through the drain tube 38 to the outside. The inspection lid 34 is opened to inspect the inside of the tank 32 periodically and to inspect the passage state or clogged state of the drain hole 30; the drain hole 30 is cleaned; and the crushed wastes and mud accumulated in the tank are removed. A waste liquid port 41 (FIG. 3) of the tank 32 is preferably disposed at an appropriate height position such that the crushed wastes remain in the tank 32 after the opening/closing valve 39 is opened to drain the waste liquid from the tank 32. As a result, the crushed wastes and mud can be prevented from entering and clogging the drain tube 38.

As described above, even when liquids such as moisture or remaining liquids remain in or adhere to collected empty cans, the can crushing machine 4 of the present invention can form can chips from all the empty cans and can separate and remove the liquids from the can chips. The hose 13 connected to the can inlet port 12 of the can crushing machine 4 is pulled from the first chamber 3*a* to the outside of the platform 1 at each empty can accumulation site when going around. Since empty cans are sucked into the hose 13 and sent to the can crushing machine 4 when the leading end of the hose 13 is applied to the stacked empty cans, a worker does not have to manually collect the empty cans and the collecting operation can be performed safely and at shorter times. If a spray can is mixed in empty cans, a remaining gas in the spray can is blown off when forming chips in the can crushing machine 4 and exhausted to the outside of the platform 1 as described above and, therefore, the risk of leakage or ignition of the gas in the spray can within the platform 1 can be certainly avoided.

The can chip outlet port 14 of the can crushing machine 4 is connected to one end of the can chip outlet tube 55. The can chip outlet tube 55 passes through an opening 70 of the partition wall 2*a* and extends to the second chamber 3*b*, and the other end or leading end is connected to an inlet port of the can chip magnetic separation machine 5 described later.

Figure 7:
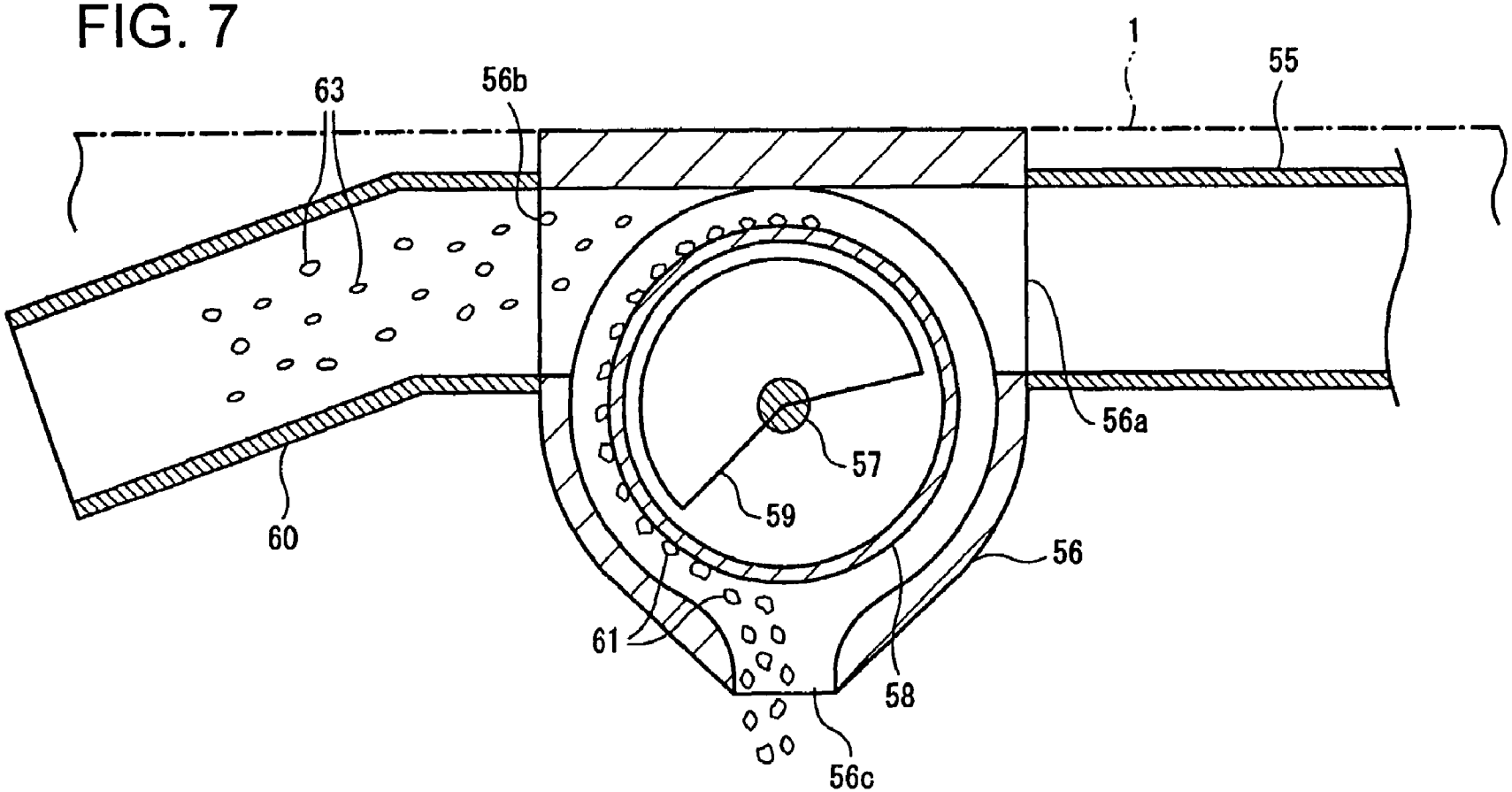
FIG. 7 is a cross sectional side view of a magnetic separation machine.

FIG. 7 shows a configuration of the can chip magnetic separation machine 5. The can chip magnetic separation machine 5 includes a body disposed on the upper portion of the second chamber 3*b*, a rotation drum 58 attached rotatably with a shaft 57 within the body 56, and a half-moon shape magnet 59 fixed with in the rotation drum 58 to face to a substantially upper half portion of the inner circumference of the rotation drum 58. An inlet port 56*a* of the body 56 is connected with the can chip outlet tube 55 from the can chip outlet port 14 (FIG. 2), and a first outlet port, i.e., an aluminum chip outlet port 56*b* is connected with an aluminum outlet tube 60. The aluminum outlet tube 60 passes through an opening 71 of the partition wall 2*b* and extends to the third chamber 3*c*, and the leading end thereof is opened obliquely downward in the third chamber 3*c*. A second outlet port, i.e., a steel chip outlet port 56*c* of the body 56 is opened downward and terminated in the second chamber 3*b*.

Figure 8:
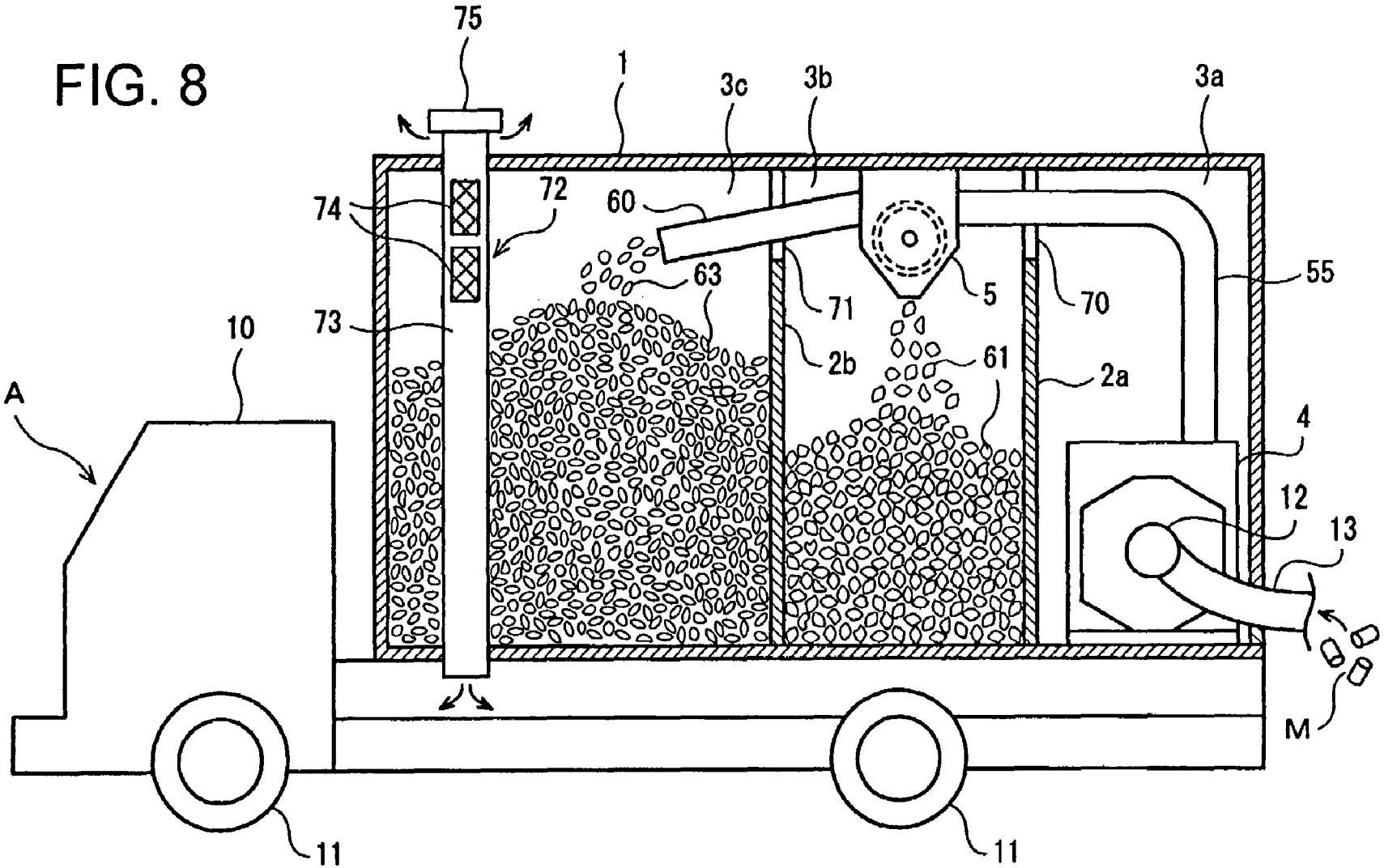
FIG. 8 is a cross sectional side view of an action of an empty can collecting process in the embodiment.

In this can chip magnetic separation machine 5, among the can chips sent from the inlet port 56*a* into the body 56, steel chips 61 are moved downward while attracted to the outer circumference of the rotation drum 58 facing to the magnet 59, are separated from the rotation drum 58 at a position away from the magnet 59 where the magnetic attraction disappears, are dropped from the steel chip outlet port 56*c*, and are accumulated on the floor of the second chamber 3*b* as shown in FIG. 8.

On the other hand, aluminum chips are blown from the aluminum chip outlet port 56*b* into the aluminum outlet tube 60 without being attracted by the rotation drum 58, are discharged and dropped from the opening of the leading end of the aluminum outlet tube 60 in the third chamber 3*c*, and are accumulated on the floor of the third chamber 3*c* as shown in FIG. 8.

As shown in FIGS. 1, 2, and 8, an exhaust stack 72 is disposed in the third chamber 3*c*. The exhaust stack 72 includes a cylindrical body 73 with opened ends, which penetrates the third chamber 3*c* in the vertical direction to project to the outside (under the floor and above the roof) of the platform 1, and air holes 74 in the form of meshes or a number of holes disposed on the side surface or circumferential surface of the cylindrical body 73 in the third chamber 3*c*. The air holes 74 are preferably disposed at positions higher than an aluminum chip storage space 77 (FIG. 9) established in the third chamber 3*c*. A rain cover 75 is attached to the upper end of the cylindrical body 73.

Air and other gasses are discharged or blown into the second chamber 3*b* and the third chamber 3*c* from the can chip magnetic separation machine 5 along with the steel chips 61 and the aluminum chips 63. The gases such as air blown into the both chambers 3*b*, 3*c* enter into the cylindrical body 73 from the air holes 74 of the exhaust stack 72 and pass through the openings at the upper end and the lower end of the cylindrical body 73 to the outside, i.e., into the atmosphere. Because of the exhaust action of the exhaust stack 72, the steel chips 61 and the aluminum chips 63 are smoothly discharged in the second chamber 3*b* and the third chamber 3*c*, respectively, without resistance due to pressure increase. Odors do not remain in the chambers. To enhance the exhaust efficiency, an exhaust fan (not shown) may be disposed in the exhaust stack 72. Modifications can include a configuration with a plurality of the exhaust stacks 72 and a configuration with the exhaust stack 72 disposed in the second chamber 3*b*.

Figure 9:
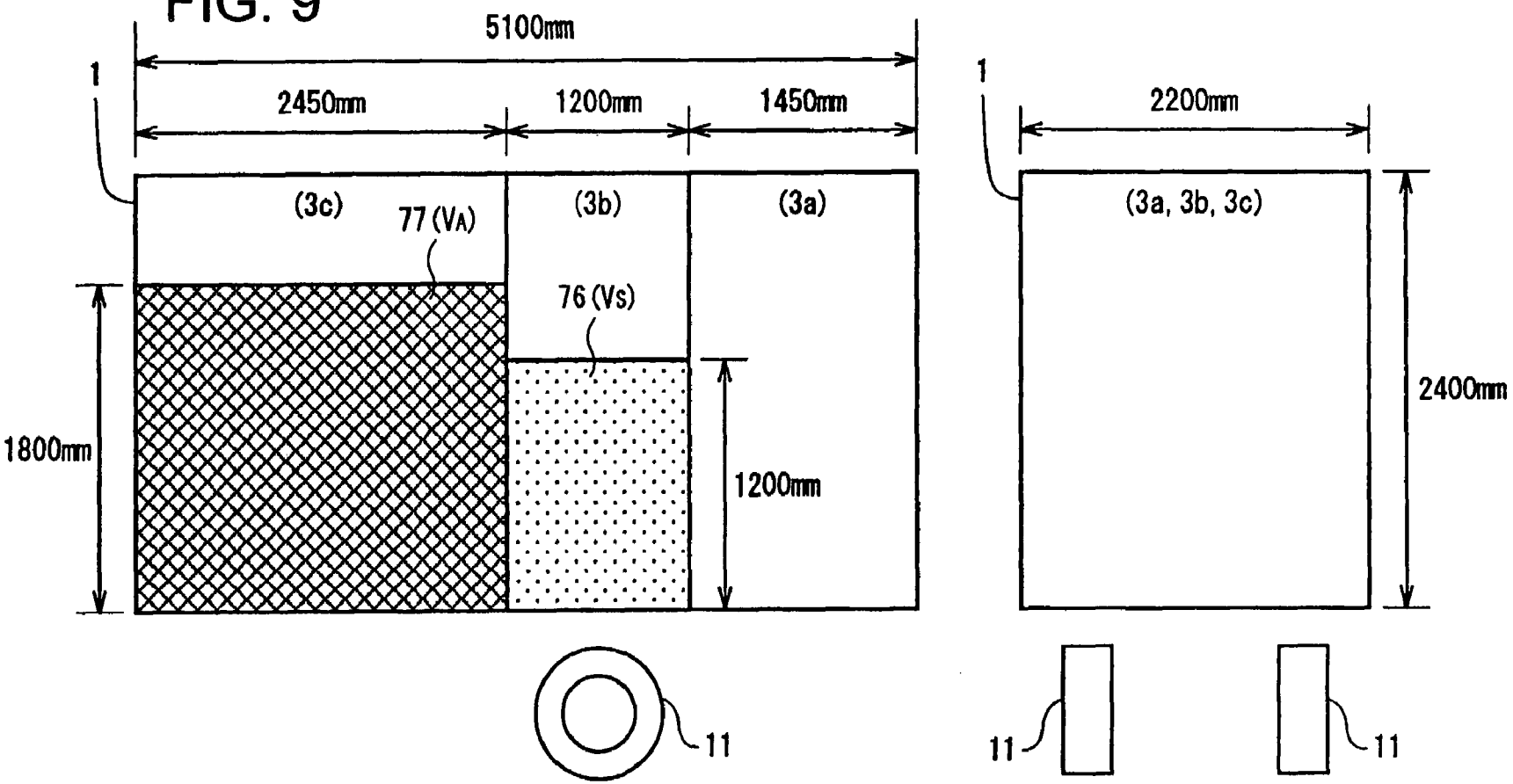
FIG. 9 is a diagram of dimensions of portions for showing one example of an empty can collecting capacity in the embodiment.

Description will be made of an example of an empty can collection capacity achievable in this embodiment. FIG. 9 shows a space size (example) of each portion in the platform 1 when an empty can processing vehicle A of the embodiment is constituted by a four-ton truck.

In FIG. 9, a size of the platform 1 is assumed to be 5100 mm (length)×2200 mm (width)×2400 mm (height). In the length direction, sizes of 1450 mm, 1500 mm, and 2450 mm are allocated to the first chamber 3*a* of the rear portion, the second chamber 3*b* of the intermediate portion, and the third chamber 3*c* of the front portion, respectively. As a result, for example, a steel chip storage space 76 of 1250 mm (length)×2200 mm (width)×1200 mm (height) can be disposed in the second chamber 3*b*. For example, an aluminum chip storage space 77 of 2450 mm (length)×2200 mm (width)×1800 mm (height) can be disposed in the third chamber 3*c*. In this case, a capacity $V_S$ of the steel chip storage space 76 is $V_S \approx 3.2$ m$^3$, and a capacity $V_A$ of the aluminum chip storage space 77 is $V_A \approx 9.5$ m$^3$.

By the way, a net load capacity of an aluminum van of a four-ton truck is about 3700 kg. When it is assumed that the total weight of machines/members such as the can crushing machine 4, the can chip magnetic separation machine 5, and the exhaust stack 72 loaded onto the van is about 500 kg in this embodiment, the maximum load capacity of the steel chips 61 and the aluminum chips 63 stored in the steel chip storage space 76 and the aluminum chip storage space 77, respectively, are about 3200 (3700−500) kg in total.

Since a weight ratio of steel cans and aluminum cans is about fifty-fifty (50%:50%) in the general empty can collection, the maximum load capacity of the steel chips 61 in the steel chip storage space 76 is about 1600 kg, and the maximum load capacity of the aluminum chips 71 in the aluminum chip storage space 77 is about 1600 kg as well. In the general empty can collection, a weight of 1 kg corresponds to 24 steel cans or 60 aluminum cans. Therefore, the steel chip storage space 76 can be loaded with chips of 38400 (1600×24) steel cans and aluminum chip storage space 77 can be loaded with chips of 96000 (1600×60) steel cans.

In terms of volume, since the density of the general empty can collection is 1600 cans/m$^3$, the steel chip storage space 76 can store chips of the empty cans (steel cans) corresponding to about 60 m$^3$, and the aluminum chip storage space 77 can store chips of the empty cans (aluminum cans) corresponding to about 24 m$^3$.

Figure 10:
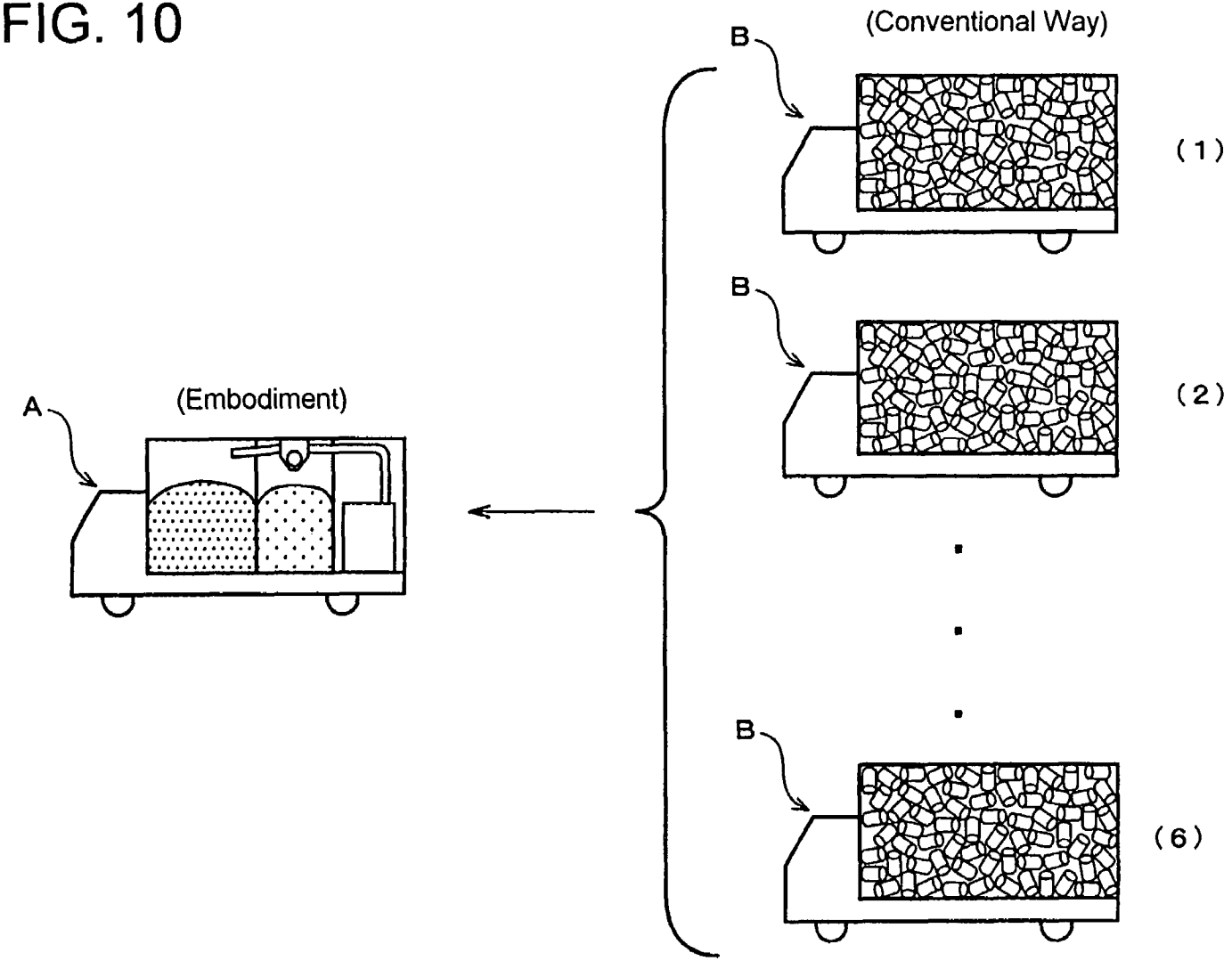
FIG. 10 is a diagram comparing one example of the empty can collecting capacity in the embodiment with a conventional example.

On the other hand, the maximum empty can load capacity is about 14 m$^3$ (about 680 kg in weight) in a conventional empty can collection vehicle B constituted by an aluminum van of a four-ton truck. As described above, since the empty can processing vehicle A in this embodiment has the maximum empty can load capacity of about 84 (64+12)m$^3$, one empty can processing vehicle A can show an empty can collection capability corresponding to six conventional empty can collection vehicles B as shown in FIG. 10. Therefore, the transportation cost of the empty can collection can be reduced to ⅙.

When the empty can processing vehicle A in this embodiment goes around the empty can accumulation sites and back to an empty can treatment center, the doors 7, 8 of the platform 1 may be opened at a predetermined chip unloading site to unload the steel chips 61 and the aluminum chips 63 from the second chamber 3*b* and the third chamber 3*c*, respectively. Since the steel chips 61 and the aluminum chips 63 include almost no liquid such as remaining liquids and foul odors are not produced, the chips can be unloaded or transferred easily at short times.

Figure 11:
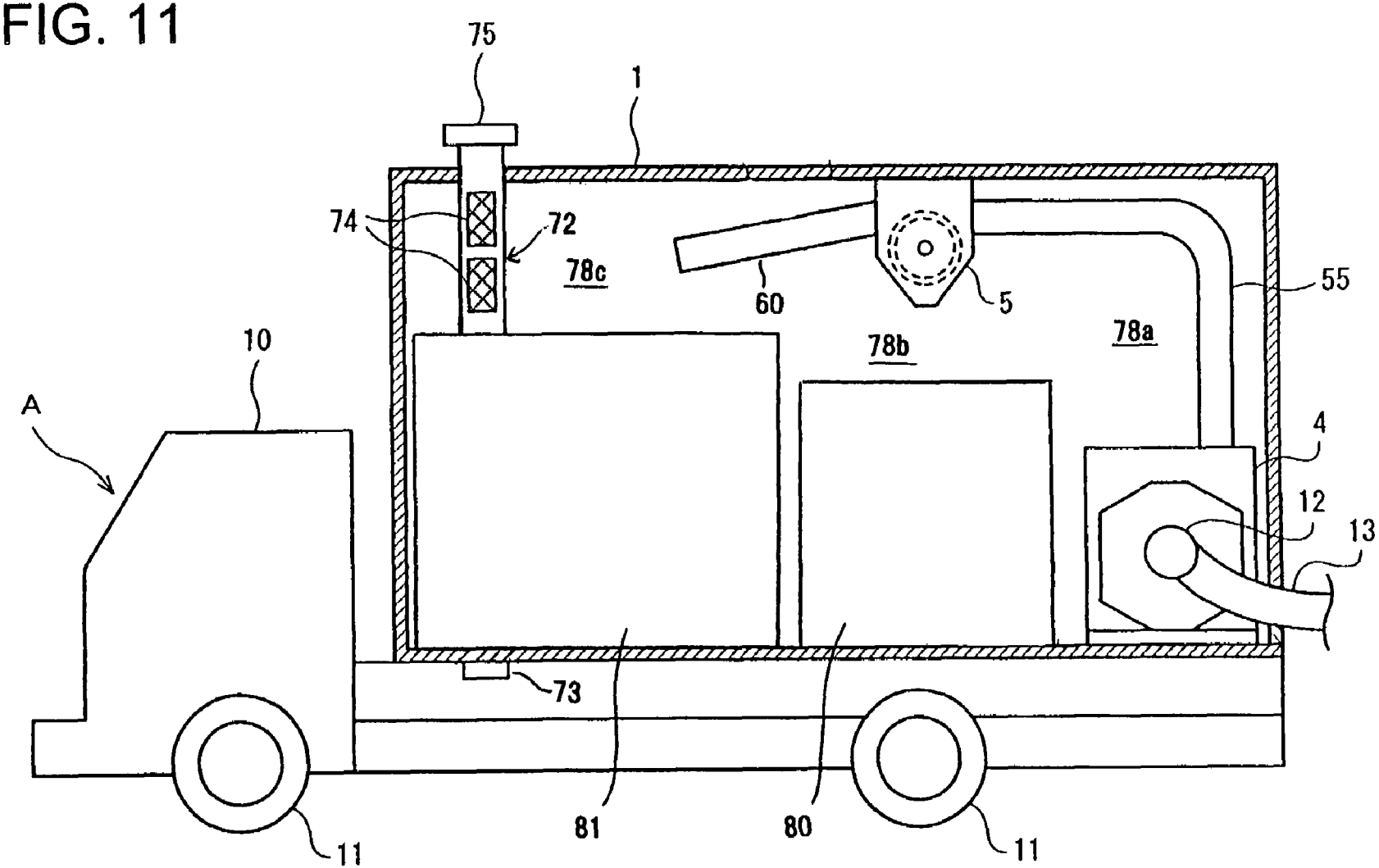
FIG. 11 is a cross sectional side view of a configuration of relevant components of an empty can processing vehicle according to one modification of the embodiment.

In another embodiment, as shown in FIG. 11, the partition walls are not disposed in the platform 1; the can crushing machine 4 can be disposes in a first space 78*a* corresponding to the first chamber 3*a* in the above embodiment (FIG. 1); the can chip magnetic separation machine 5 and a steel chip container 80 are disposed in a second space 78*b* corresponding to the second chamber 3*b*; and an aluminum chip container 81 can be disposed in a third space 78*c* corresponding to the third chamber 3*c*. The steel chip container 80 and the aluminum chip container 81 are portable and opened at the upper end.

In this case, during the empty can collecting operation, the steel chips 61 are discharged from a steel chip outlet port 5*b* of the can chip magnetic separation machine 5 in the second chamber 3*b* and are received and collected in the steel chip container 80, and the aluminum chips 63 are discharged from an aluminum chip outlet port 5*c* of the can chip magnetic separation machine 5 through the aluminum outlet tube 60 in the third chamber 3*c* and are received and collected in the aluminum chip container 81. In the empty can treatment center, the steel chip container 80 and the aluminum chip container 81 can be taken out from and put into the platform 1 with the use of a fork lift, etc.

Although the preferred embodiments of the present invention have been described, the aforementioned embodiments do not limit the present invention. Various modifications and alterations can be made in specific embodiments by those who skilled in the art without departing from the technical concept and the technical scope of the present invention.

For example, in the can crushing machine in the above embodiments, washing water may be introduced into the casing 18 in an appropriate manner such that the remaining liquids in empty cans are diluted to reduce the adhesive force thereof and increase the fluidity thereof and are easily drained from the drain hole 30. The first chamber 3*a* (first space 78*a*), the second chamber 3*b* (second space 78*b*), and the third chamber 3*c* (third space 78*c*) can be disposed in the front portion, the intermediate portion, and the rear portion, respectively, of the platform 1.

While the illustrative and presently preferred embodiment of the present invention has been described in detail herein, it is to be understood that the inventive concepts may be otherwise variously embodied and employed and that the appended claims are intended to be construed to include such variations except insofar as limited by the prior art.

What is claimed is:

1. An empty can processing vehicle comprising:

first, second, and third chambers formed by partitioning a platform of a van track;

a can crushing machine, located in the first chamber, and comprising a can inlet port, a can crushing chamber, and a can chip outlet port, said can crushing machine configured to crush an empty can introduced from the can inlet port to the can crushing chamber and to discharge can chips from the can chip outlet port; and a can chip magnetic separation machine disposed in the second chamber to separate the can chips discharged from the can chip outlet port into steel chips and aluminum chips through magnetic force, the vehicle storing the steel chips separated by the can chip magnetic separation machine in the second chamber, the vehicle storing the aluminum chips separated by the can chip magnetic separation machine in the third chamber, wherein the can crushing machine includes:

a cylindrical casing that includes the can crushing chamber, the can inlet port, and the can chip outlet port;

an impeller that sucks air from the can inlet port and sends air toward the can chip outlet port to guide the empty can introduced from the can inlet port to the circumferential direction of the casing;

a plurality of can crushing blades that is located at positions surrounding the outer circumference of the impeller to crush the empty can guided by the rotation of the impeller; and a can chip guide path that guides the can chips generated by crushing the empty can to the can chip outlet port through the rotation of the impeller.

2. The empty can processing vehicle of claim 1, wherein a drain hole is formed in the casing to drain liquids or fluids from the can chip guide path.

3. The empty can processing vehicle of claim 2, wherein the drain hole is formed in the lower portion of the casing.

4. The empty can processing vehicle of claim 2, wherein a tank is disposed on the outside of the casing to temporarily store the liquids or fluids drained from the drain hole.

5. An empty can processing vehicle comprising: first, second, and third chambers formed by partitioning a platform of a van track;

a can crushing machine, located in the first chamber, and comprising a can inlet port, a can crushing chamber, and a can chip outlet port, said can crushing machine configured to crush an empty can introduced from the can inlet port to the can crushing chamber and to discharge can chips from the can chip outlet port; and a can chip magnetic separation machine disposed in the second chamber to separate the can chips discharged from the can chip outlet port into steel chips and aluminum chips through magnetic force, the vehicle storing the steel chips separated by the can chip magnetic separation machine in the second chamber, the vehicle storing the aluminum chips separated by the can chip magnetic separation machine in the third chamber, wherein the can chip magnetic separation machine includes:

a body disposed on the upper portion of the second chamber, the body including a can chip inlet port for introducing the can chips from the can crushing machine, a steel chip outlet port that is terminated in the second chamber, and an aluminum chip outlet port leading to the third chamber;

a rotation drum attached rotatably within the body; and a magnet disposed to face to a substantially upper half portion of the inner circumference of the rotation drum, and wherein among the can chips introduced from the can chip inlet port into the body, the steel chips are moved downward while attracted to the outer circumference of the rotation drum facing to the magnet, are separated from the rotation drum at a position away from the magnet, and are discharged from the steel chip outlet port and, after removing the steel chips, the remaining aluminum chips are discharged from the aluminum chip outlet port.

6. The empty can processing vehicle of claim 5, comprising a can chip outlet tube that passes through a partition wall partitioning the first chamber and the second chamber to extend into the both chambers, the can chip outlet tube being connected at a stat end to the can chip outlet port of the crushing machine, the can chip outlet tube being connected at a terminal end to the can chip inlet port of the can chip magnetic separation machine.

7. The empty can processing vehicle of claim 5, comprising an aluminum chip outlet tube that passes through a partition wall partitioning the second chamber and the third chamber to extend into the both chambers, the aluminum chip outlet tube being connected at a stat end to the aluminum chip outlet port of the body of the can chip magnetic separation machine and is opened at a terminal end in the third chamber.

* * * * *